US007712456B2

(12) United States Patent
Hirano

(10) Patent No.: US 7,712,456 B2
(45) Date of Patent: May 11, 2010

(54) BLOW-BY GAS PROCESSING APPARATUS

(75) Inventor: Satoshi Hirano, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 7 days.

(21) Appl. No.: 11/905,827

(22) Filed: Oct. 4, 2007

(65) Prior Publication Data

US 2008/0110443 A1 May 15, 2008

(30) Foreign Application Priority Data

Nov. 10, 2006 (JP) ..... 2006-305464

(51) Int. Cl.
*F01M 13/00* (2006.01)
*F01M 13/02* (2006.01)

(52) U.S. Cl. ..... 123/572

(58) Field of Classification Search ..... 123/572–574, 123/559.1, 41.86
See application file for complete search history.

(56) References Cited

U.S. PATENT DOCUMENTS

| | | | | |
|---|---|---|---|---|
| 4,901,703 | A * | 2/1990 | Humphries | 123/572 |
| 4,962,745 | A | 10/1990 | Ohno et al. | |
| 5,456,239 | A | 10/1995 | Henderson et al. | |
| 6,691,687 | B1 | 2/2004 | Liang et al. | |
| 2002/0046743 | A1 * | 4/2002 | Moren | 123/572 |
| 2003/0140909 | A1 * | 7/2003 | Criddle et al. | 123/572 |
| 2004/0112346 | A1 | 6/2004 | Ahlborn et al. | |
| 2006/0243258 | A1 * | 11/2006 | Withrow et al. | 123/559.1 |
| 2007/0028903 | A1 * | 2/2007 | Bruchner et al. | 123/574 |
| 2007/0199550 | A1 * | 8/2007 | Lindmark et al. | 123/572 |

FOREIGN PATENT DOCUMENTS

| | | |
|---|---|---|
| DE | 100 43 796 A1 | 3/2002 |
| DE | 201 03 874 U1 | 8/2002 |
| DE | 20 2004 011 882 U1 | 1/2006 |
| JP | 57-026218 | 2/1982 |
| JP | 62-150514 | 9/1987 |
| JP | U 5-87213 | 11/1993 |
| JP | A2001-164918 | 6/2001 |
| JP | A 2004-60475 | 2/2004 |
| JP | 2005-042681 | 2/2005 |
| JP | A 2006-144686 | 6/2006 |
| JP | A 2006-250080 | 9/2006 |

* cited by examiner

*Primary Examiner*—Marguerite McMahon
(74) *Attorney, Agent, or Firm*—Oliff & Berridge, PLC

(57) ABSTRACT

An upstream portion of an intake passage is positioned upstream of a supercharger. An intermediate portion is positioned between the supercharger and a throttle valve. A downstream portion is positioned downstream of the throttle valve. A blow-by gas processing apparatus has a first breather passage, a second breather passage, and an introduction passage. The first breather passage connects an interior of the engine with the downstream portion. The second breather passage has a pump that pressure feeds gas from the interior of the engine to the intake passage. The introduction passage connects at least one of the upstream portion and the intermediate portion with the interior of the engine. Accordingly, the interior of the engine is efficiently ventilated.

9 Claims, 9 Drawing Sheets

BLOW-BY GAS PROCESSING APPARATUS

BACKGROUND OF THE INVENTION

The present invention relates to a blow-by gas processing apparatus provided in an internal combustion engine provided with a supercharger.

A vehicle internal combustion engine can be provided with, for example, a blow-by gas processing apparatus. The blow-by gas processing apparatus recirculates a combustion gas leaking to a crank chamber from a gap between a cylinder and a piston of the engine, that is, a blow-by gas to an intake passage. Specifically, an intake negative pressure generated in a portion of the intake passage in a downstream side of a throttle valve draws the blow-by gas in an interior of the engine so as to flow into a breather passage. The blow-by gas is returned to the intake passage from the breather passage, is again fed to the combustion chamber, and is burned. Accordingly, it is possible to reduce a discharge amount of hydrocarbon (HC) to the atmosphere. Further, it is possible to inhibit the blow-by gas from deteriorating oil in the interior of the engine. As mentioned above, the blow-by gas processing apparatus ventilates the interior of the engine.

However, in the case that the supercharger is provided in the engine, if the supercharger is operated, the intake negative pressure is lost. Japanese Laid-Open Patent Publication No. 2001-164918 discloses a gas pump provided in a breather passage, however, no supercharger is provided in the engine in the publication.

An objective of the present invention is to provide a blow-by gas processing apparatus which efficiently ventilates the interior of an engine.

In accordance with one aspect of the present invention, a blow-by gas processing apparatus applicable to an internal combustion engine is provided. An intake passage extends from the engine. Intake air flows from an upstream side to a downstream side in the intake passage, whereby the intake air flows toward the engine. A supercharger and a throttle valve are arranged in the intake passage. A throttle valve is positioned downstream of the supercharger. The supercharger pressure feeds the intake air flowing through the intake passage toward the engine, thereby supercharging the intake air to the engine. The throttle valve variably sets a passage cross-sectional area of the intake passage. The intake passage has an upstream portion, an intermediate portion, and a downstream portion. The upstream portion is positioned upstream of the supercharger. The intermediate portion is positioned between the supercharger and the throttle valve. The downstream portion is positioned in a downstream side of the throttle valve. The processing apparatus has a first breather passage, a second breather passage, and an introduction passage. The first breather passage connects the interior of the engine with the downstream portion. The first breather passage has a one-way valve allowing only a gas discharge from the interior of the engine to the intake passage. The second breather passage connects the interior of the engine with the intake passage. The second breather passage has a pump pressure feeding the gas to the intake passage from the interior of the engine. The introduction passage connects at least one of the upstream portion and the intermediate portion with the interior of the engine.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
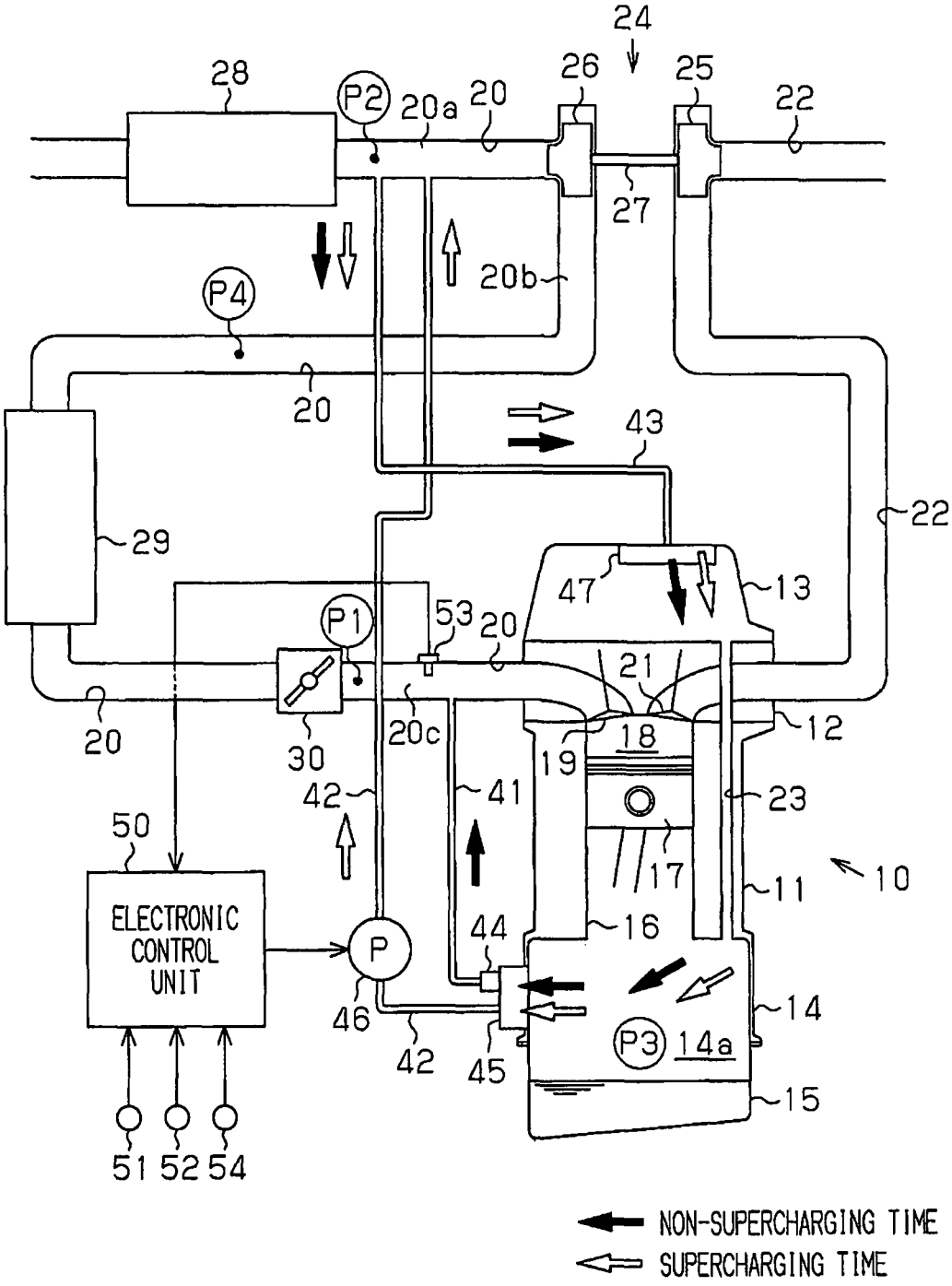
FIG. 1 is a schematic view of a blow-by gas processing apparatus in accordance with a first embodiment of the present invention.

FIGS. 1 to 4 show a first embodiment according to the present invention. FIG. 1 shows an engine 10 to which a blow-by gas processing apparatus in accordance with a first embodiment is applied.

As shown in FIG. 1, the engine 10 is an internal combustion engine provided with a cylinder block 11. A cylinder head 12 is provided on an upper portion of the cylinder block 11. A head cover 13 is installed to an upper portion of the cylinder head 12. A crankcase 14 is formed in a lower portion of the cylinder block 11. An oil pan 15 is attached to a lower portion of the crankcase 14. Oil for lubricating the engine 10 is stored in the oil pan 15. Hereinafter, the interior of the engine 10 represents interior of the head cover 13 and a crank chamber 14*a*.

A cylinder 16 is formed in the cylinder block 11. A piston 17 is arranged in the cylinder 16 so as to reciprocate. The engine 10 has a combustion chamber 18. An inner peripheral wall of the cylinder 16, a top surface of the piston 17, and a lower surface of the cylinder head 12 define the combustion chamber 18. An intake passage 20 is connected to the combustion chamber 18 via an intake valve 19, and an exhaust passage 22 is connected thereto via an exhaust valve 21. In other words, each of the intake passage 20 and the exhaust passage 22 extends from the engine 10. A communicating passage 23 is formed in the engine 10. The communicating passage 23 extends in such a manner as to connect the interior of the head cover 13 with the crank chamber 14*a*.

One exhaust-driven supercharger 24 is provided in the intake passage 20 and the exhaust passage 22. The supercharger 24 is provided with a turbine wheel 25 provided in the exhaust passage 22, and a compressor impeller 26 provided in the intake passage 20. The shaft 27 couples the turbine wheel 25 to the compressor impeller 26 in such a manner as to be integrally rotatable.

If the amount of the exhaust gas flowing through the exhaust passage 22 becomes large so as to be sprayed to the turbine wheel 25, the turbine wheel 25 and the compressor impeller 26 are integrally rotated. Accordingly, the intake air flowing through the intake passage 20 is forcibly pressure-fed to the combustion chamber 18. In other words, the supercharger 24 supercharges the intake air to the combustion chamber 18. The supercharger 24 is not operated in the case that a load of the engine 10 is close to zero (work load≈"0"), and is operated in the case that the load of the engine 10 is large (work load>>"0"). In other words, the supercharger 24 is not operated in the case that the amount of the exhaust gas flowing through the exhaust passage 22 is small, and is operated in the case that the amount of the exhaust gas is large.

The intake air flows to a downstream side from an upstream side in the intake passage 20, whereby the intake air flows toward the engine 10. In other words, the intake air in the intake passage 20 flows from an upstream side in an intake air flowing direction toward a downstream side, thereby moving toward the engine 10. An air cleaner 28, the compressor impeller 26, an intercooler 29 and a throttle valve 30 are arranged in the intake passage 20 in this order from the upstream side toward the downstream side. The air cleaner 28 filtrates the intake air. The intercooler 29 lowers a temperature of the intake air by executing a heat exchange between the intake air and the external ambient atmosphere. The throttle valve 30 is a throttle valve variably setting a passage cross-sectional area of the intake passage 20. The turbine wheel 25 is arranged in the exhaust passage 22. The engine 10 is provided with a fuel injection valve (not shown) injecting (supplying) the fuel to the combustion chamber 18. The engine 10 need not be a direct fuel-injection engine having the fuel injection valve, but may be a port-injection engine or a diesel engine.

The intake passage 20 has an upstream portion 20*a*, an intermediate portion 20*b*, and a downstream portion 20*c*. The upstream portion 20*a* corresponds to a portion of the intake passage 20 between the air cleaner 28 and the supercharger 24. In other words, the upstream portion 20*a* corresponds to a portion of the intake passage 20 in an upstream side of the supercharger 24. The intermediate portion 20*b* corresponds to a portion of the intake passage 20 between the supercharger 24 and the throttle valve 30. In other words, the upstream portion 20*a* and the intermediate portion 20*b* correspond to a portion of the intake passage 20 in an upstream side of the throttle valve 30. The downstream portion 20*c* corresponds to a portion of the intake passage 20 in a downstream side of the throttle valve 30.

The pressure of the downstream portion 20*c* is referred to as a downstream pressure P1. In other words, the downstream pressure P1 indicates a pressure in an interior of the passage in the portion of the intake passage 20 in the downstream side of the throttle valve 30. A pressure of the upstream portion 20*a* is referred to as an upstream pressure P2. A pressure of the crank chamber 14*a* is referred to as an engine internal pressure P3. A pressure of the intermediate portion 20*b* is referred to as an intermediate pressure P4. The state in which the downstream pressure P1 is made higher than the atmospheric pressure by the operation of the supercharger 24 is referred to as "supercharging time", and the state in which the downstream pressure P1 is lower than the atmospheric pressure is referred to as "non-supercharging time."

Combustion gas in the combustion chamber 18 passes through a gap of sliding surfaces between the cylinder 16 and the piston 17, and leaks to the crank chamber 14*a*. The combustion gas leaking as mentioned above corresponds to a blow-by gas. Hereinafter, the blow-by gas leaking to the crank chamber 14*a* from the combustion chamber 18 may be referred to as a leaked blow-by gas. The engine 10 is provided with a blow-by gas processing apparatus recirculating the blow-by gas to the intake passage 20.

The blow-by gas processing apparatus is provided with a first breather passage 41, a second breather passage 42, and an introduction passage 43. Each of the first breather passage 41 and the second breather passage 42 discharges the blow-by gas in the crank chamber 14*a* to the intake passage 20. In other words, the blow-by gas in of the engine 10 passes through the first breather passage 41 or the second breather passage 42, and is recirculated to the intake passage 20. The introduction passage 43 introduces a part of the intake air of the intake passage 20 into the interior of the head cover 13. In other words, a part of the intake air in the intake passage 20 passes through the introduction passage 43, and can flow into the interior of the engine 10.

The first breather passage 41 connects the crank chamber 14*a* with the downstream portion 20*c*. In other words, an inlet of the first breather passage 41 is connected to the crank chamber 14*a* via a positive crankcase ventilation (PCV) valve 44. The inlet of the breather passage 41 corresponds to an end portion of the side of the crankcase 14 of the first breather passage 41. An outlet of the first breather passage 41 is connected to the downstream portion 20*c*.

The PCV valve 44 corresponds to a one-way valve, and a differential pressure valve. In the case that the engine internal pressure P3 is higher than the downstream pressure P1, an opening degree of the PCV valve 44 is reduced as the pressure difference between both the pressures is increased. In other words, the PCV valve 44 autonomously regulates a flow rate of the blow-by gas passing through the first breather passage 41 on the basis of the pressure difference between the downstream pressure P1 and the engine internal pressure P3. In the case that the engine internal pressure P3 is equal to or less than the downstream pressure P1, the PCV valve 44 is closed. The PCV valve 44 corresponding to the one-way discharge valve allows the blow-by gas in the crank chamber 14*a* to recirculate to the intake passage 20, however, inhibits the intake air in the intake passage 20 from flowing into the crank chamber 14*a*.

A first oil separator 45 is arranged in the crankcase 14. The first oil separator 45 separates oil mist from the blow-by gas. The PCV valve 44 is connected to the first oil separator 45. In other words, an inlet of the first breather passage 41 is connected to the crank chamber 14*a* via the PCV valve 44 and the first oil separator 45.

The second breather passage 42 connects the crank chamber 14*a* with the upstream portion 20*a*. An electrically driven pump 46 is provided in the middle of the second breather passage 42. The pump 46 is a scavenging pump that pressure feeds the gas in the crank chamber 14*a* to the intake passage 20. In other words, the pump 46 forcibly discharges the blow-by gas in the crank chamber 14*a* to the intake passage 20.

An inlet of the second breather passage 42 is connected to the first oil separator 45. In other words, both of the inlet of the first breather passage 41 and the inlet of the second breather passage 42 communicate with the first oil separator 45. In other words, the first oil separator 45 is the same portion (common portion) to which both of the inlet of the first breather passage 41 and the inlet of the second breather passage 42 are connected.

The introduction passage 43 connects the upstream portion 20*a* with the interior of the head cover 13. An inlet of the introduction passage 43 is connected to the upstream portion 20*a* in an upstream side of an outlet of the second breather passage 42. In other words, the inlet of the introduction passage 43 corresponds to an end portion of the side of the intake passage 20 of the introduction passage 43. A second oil separator 47 separating an oil mist from the blow-by gas is arranged in the head cover 13. An outlet of the introduction passage 43 is connected to the second oil separator 47.

The engine control unit controlling the engine 10 has various sensors detecting the operating states of the engine 10. The various sensors include an accelerator pedal sensor 51, a speed sensor 52, a pressure sensor 53, and a temperature sensor 54. The accelerator pedal sensor 51 detects a pedaling amount of the accelerator pedal (not shown), that is, an accelerator pedal operating amount AC. The speed sensor 52 detects a rotating speed of an engine output shaft (not shown), that is, an engine speed NE. The pressure sensor 53 detects a downstream pressure P1. The temperature sensor 54 detects a temperature of an engine coolant, that is, a coolant temperature THW. The coolant temperature THW corresponds to an index value of the temperature of the engine 10.

The engine control unit is provided with an electronic control unit 50 including a microcomputer. The electronic control unit 50 loads the output signals of the sensors 51 to 54, carries out various computations on the basis of these signals, and carries out various controls in connection with the operation of the engine 10 on the basis of the results of computations. In other words, the electronic control unit 50 carries out a fuel injection control for controlling a fuel injection valve (not shown) and a pump control for controlling a pump 46.

The electronic control unit 50 calculates a target fuel injection amount Qm corresponding to a control target value of a fuel injection amount on the basis of an accelerator pedal operation amount AC and an engine speed NE indicating an operating state of the engine 10, at a time of executing a fuel injection control. The electronic control unit 50 opens and closes the fuel injection valve in correspondence to the target fuel injection amount Qm. As a result, the fuel injection valve injects a fuel amount matching to the operating state of the engine 10.

The electronic control unit 50 increases the target fuel injection amount Qm in the case that the coolant temperature THW is low. In other words, the electronic control unit 50 executes a process to increase the target fuel injection amount Qm in the case that the coolant temperature THW is low.

In the case that the temperature of the engine 10 is low, a part of the fuel injected to the combustion chamber 18 collects on a wall surface of the combustion chamber 18. Accordingly, the part of the fuel does not burn in the combustion chamber 18. An unburned phenomenon of the fuel in the combustion chamber 18 causes a torque shortage of the engine 10, thereby generating an unstableness of the operating state of the engine 10. Accordingly, the unburned phenomenon is not preferable. In order to avoid disadvantages mentioned above, the electronic control unit 50 executes an amount increasing process of the amount Qm. As the temperature of the engine 10 becomes lower, the amount of the unburned fuel in the combustion chamber 18 is increased. Accordingly, in the amount increase compensating process, the electronic control unit 50 increases the fuel injection amount as the coolant temperature THW is lowered.

Further, the electronic control unit 50 controls the pump 46 on the basis of the downstream pressure P1 (a pump control). In other words, the blow-by gas processing apparatus is provided with the electronic control unit 50. At the non-supercharging time, the downstream pressure P1 is low. In this case, the electronic control unit 50 stops the pump 46. In other words, in the case that the intake negative pressure exists and a relative value of the downstream pressure P1 to the atmospheric pressure is large in a negative direction, the pump 46 is maintained in a stop state. An intake negative pressure refers to an intake pressure that has a negative value when the atmospheric pressure is defined as zero. If the downstream pressure P1 ascends such as the supercharging time, the electronic control unit 50 drives the pump 46. In other words, if the downstream pressure P1 becomes higher than a predetermined value, the electronic control unit 50 drives the pump 46.

Next, a description will be given of an operation of the blow-by gas processing apparatus.

At a non-supercharging time, the intake negative pressure is generated. In other words, the downstream pressure P1 at the non-supercharging time is lower than an upstream pressure P2. Accordingly, a gas flow shown by filled-in arrows in FIG. 1 is generated on the basis of a pressure difference between the downstream pressure P1 and the upstream pressure P2. In other words, the intake air flowing through the upstream portion 20*a*, that is, the intake air passes through the introduction passage 43 and is introduced into the interior of the engine 10. As shown by the filled-in arrows in FIG. 1, the blow-by gas in the engine 10 passes through the first breather passage 41 and is drawn (recirculated) into the intake passage 20.

Figure 2:
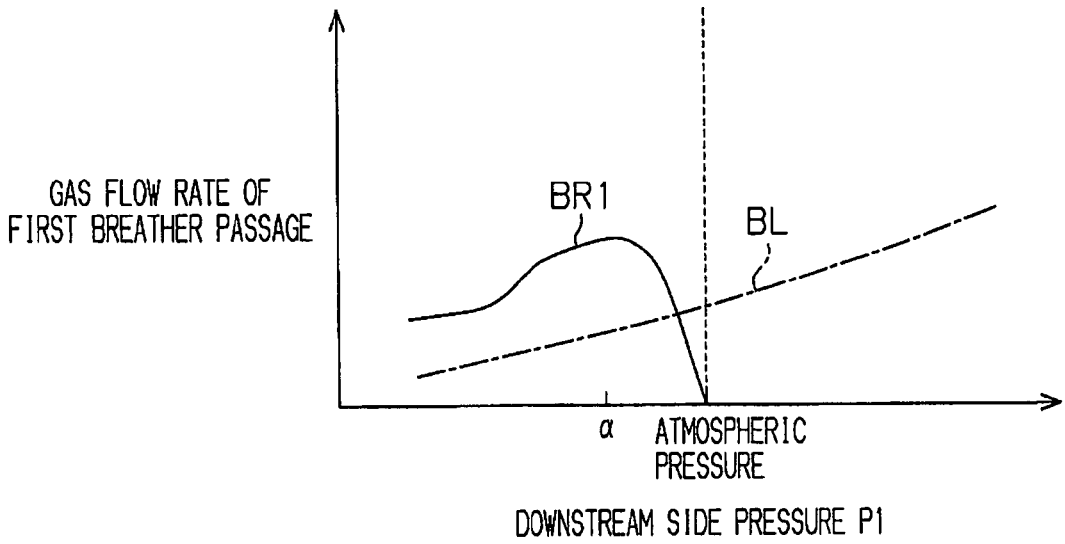
FIG. 2 is a graph showing a relationship between a gas flow rate of the first breather passage shown in FIG. 1, and a pressure in a downstream side of a throttle valve.

FIG. 2 shows a first breather line BR1 indicating a relationship between a gas flow rate of the first breather passage 41 and the downstream pressure P1 by a solid line. A chain line in FIG. 2 indicates a leaking flow rate BL of the blow-by gas from the combustion chamber 18 to the crank chamber 14*a*. In other words, the leaking flow rate BL corresponds to the amount of the leaking blow-by gas per unit of time. If the downstream pressure P1 is increased, the leaking flow rate BL increased monotonically. In other words, if the downstream pressure P1 is increased over both of a case that the downstream pressure P1 is less than the atmospheric pressure and a case that it is equal to or more than the atmospheric pressure, the leaking flow rate BL increases monotonically.

As shown in FIG. 2, if the downstream pressure P1 is changed, the first breather line BR1 is changed. In other words, in the case that the downstream pressure P1 is lower than the atmospheric pressure, if the downstream pressure P1 is increased, the first breather line BR1 is increased, and rapidly decreases below a maximum value. In the case that the downstream pressure P1 is equal to or more than the atmospheric pressure, the first breather line BR1 is zero. A value of the downstream pressure P1 in the case that the first breather line BR1 is close to the maximum value is referred to as a drive starting pressure $\alpha$. The drive starting pressure $\alpha$ is a predetermined value which is lower than the atmospheric pressure.

As shown in FIG. 2, in the case that the downstream pressure P1 is lower than the atmospheric pressure, that is, the intake negative pressure exists, the first breather line BR1 is larger than the leaking flow rate BL of the blow-by gas. Accordingly, at the non-supercharging time, the downstream pressure P1 (the intake negative pressure) draws the gas in the engine 10 into the first breather passage 41 at a flow rate which is larger than the leaking flow rate BL of the blow-by gas, and recirculates the gas to the intake passage 20.

Figure 3:
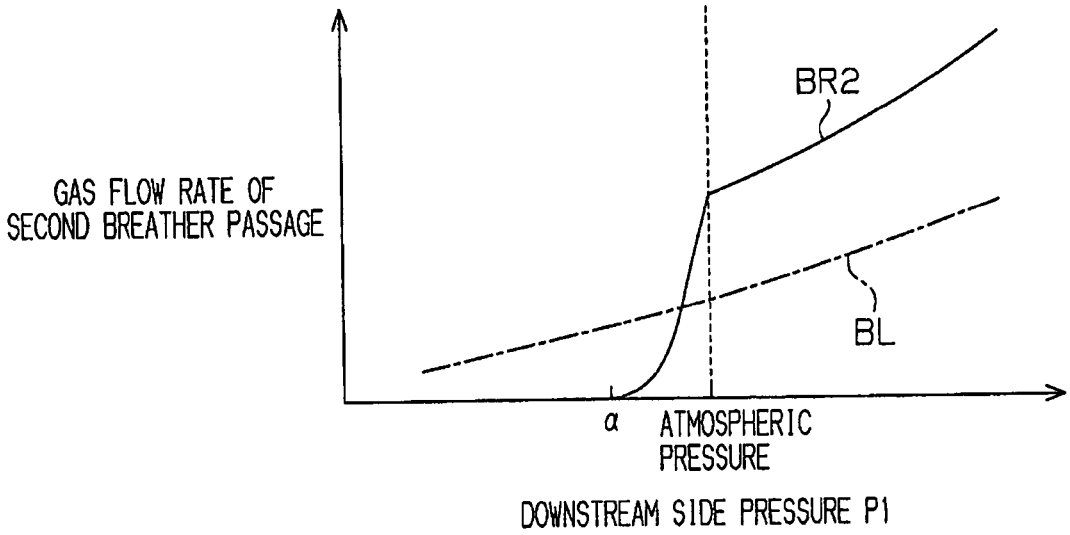
FIG. 3 is a graph showing a relationship between a gas flow rate of the second breather passage shown in FIG. 1, and the pressure in the downstream side of the throttle valve.

FIG. 3 shows a second breather line BR2 indicating a relationship between a gas flow rate of the second breather passage 42, and the downstream pressure P1. A chain line corresponds to the leaking flow rate BL of the blow-by gas.

As shown in FIG. 3, in the case that the downstream pressure P1 is lower than the drive starting pressure α, the electronic control unit 50 stops the pump 46. Accordingly, as shown by the first breather line BR1 in FIG. 2, only a ventilation of the interior of the engine 10 caused by the intake negative pressure is executed. In other words, the drive starting pressure a corresponds to a threshold value for determining whether or not starting the drive of the pump 46.

In other words, the blow-by gas processing apparatus ventilates the interior of the engine 10 on the basis of the intake negative pressure at the non-supercharging time. In other words, the pump 46 is not always driven at an operating time of the engine 10, but the pump 46 is stopped in the case that the downstream pressure P1 is lower than the drive starting pressure α. In other words, in the case that the intake negative pressure can ventilate the interior of the engine 10, the electronic control unit 50 stops the pump 46. Accordingly, the pump 46 is efficiently driven.

On the other hand, at the supercharging time, the downstream pressure P1 is increased, and the intake negative pressure is lost. In this case, as shown in FIG. 2, the first breather line BR1 comes to zero. In other words, the blow-by gas discharge generated by the first breather passage 41 is stopped. However, in the case that the downstream pressure P1 is equal to or more than the drive starting pressure α as shown in FIG. 3, the electronic control unit 50 drives the pump 46. Accordingly, the pump 46 forcibly draws the gas in the engine 10 to the second breather passage 42, and recirculates the gas to the intake passage 20. Therefore, as shown by open arrows in FIG. 1, the blow-by gas in the engine 10 passes through the second breather passage 42 and is returned to the intake passage 20. As a result, since the gas in the engine 10 is reduced, the intake air in the intake passage 20, that is, the intake air flows through the introduction passage 43 so as to be drawn (introduced) to the interior of the engine 10.

As shown in FIG. 2, the electronic control unit 50 controls the gas pressure feeding amount of the pump 46 on the basis of the downstream pressure P1. Specifically, since the first breather line BR1 suddenly decreases in the case that the downstream pressure P1 exists between the drive starting pressure α and the atmospheric pressure, the electronic control unit 50 suddenly increases the second breather line BR2. In the case that the downstream pressure P1 is equal to or more than the atmospheric pressure, the second breather line BR2 is always positioned above the leaking flow rate BL of the blow-by gas. In the case that the downstream pressure P1 is equal to or more than the atmospheric pressure, the electronic control unit 50 raises the second breather line BR2 in accordance with a steeper slope than the leaking flow rate BL of the blow-by gas little by little.

Figure 4:
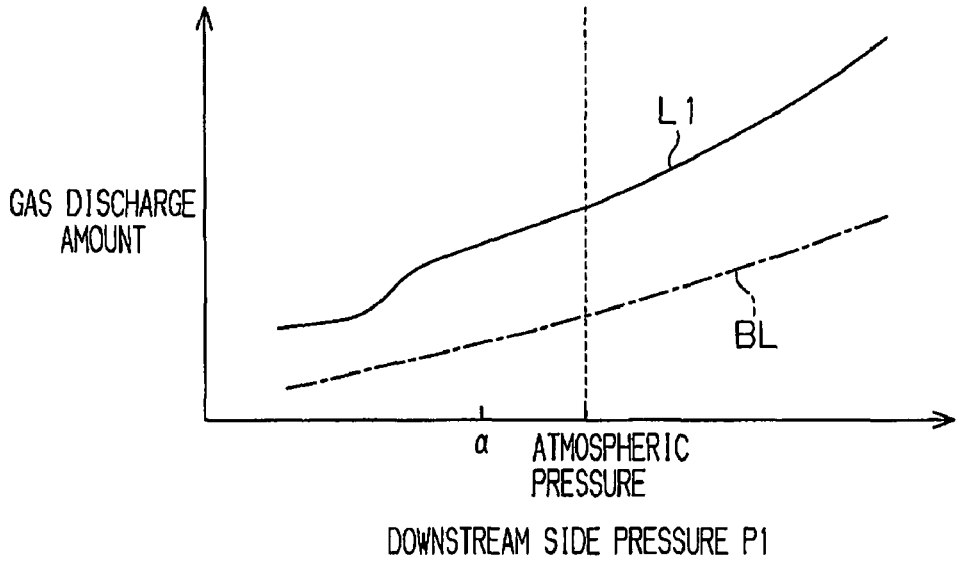
FIG. 4 is a graph showing a relationship between a gas discharge amount from the interior of the engine shown in FIG. 1 to an intake passage, and a pressure in a downstream side of the throttle valve.

FIG. 4 shows a relationship between a total breather line L1 and the downstream pressure P1. The total breather line L1 corresponds to a sum of the first breather line BR1 and the second breather line BR2. In other words, the total breather line L1 indicates a total of the gas discharge amount from the interior of the engine 10 to the intake passage 20 by the first breather passage 41, and the gas discharge amount from the interior of the engine 10 to the intake passage 20 by the second breather passage 42.

As shown in FIG. 4, the electronic control unit 50 drives the pump 46 in such a manner that the total breather line L1 is positioned above the leaking flow rate BL of the blow-by gas at any downstream pressure P1. In other words, if the downstream pressure P1 is increased in both of the case that the downstream pressure P1 is less than the atmospheric pressure and the case that it is equal to or more than the atmospheric pressure, the total breather line L1 is increased monotonically. In other words, in order to compensate the lack of the gas discharge capacity on the basis of the reduction of the intake negative pressure, the electronic control unit 50 regulates the gas discharge amount from the interior of the engine 10 to the second breather passage 42 by controlling the pump 46. Accordingly, the blow-by gas in the engine 10 is sufficiently recirculated to the intake passage 20. In other words, the interior of the engine 10 is sufficiently ventilated. As mentioned above, the first embodiment ensures the ventilation function of the blow-by gas by driving the pump 46 at the supercharging time. In other words, even if the supercharger 24 increases the downstream pressure P1, that is, the intake negative pressure comes to zero, the pump 46 ensures the ventilation function of the blow-by gas.

An inlet of the introduction passage 43 is connected to the upstream portion 20*a*. Accordingly, even if the supercharger 24 increases the intermediate pressure P4 and the downstream pressure P1, the intermediate pressure P4 and the downstream pressure P1 are not directly introduced to the interior of the engine 10. Therefore, it is possible to prevent the pressure in the engine 10 from becoming excessively high.

Since the intermediate portion 20*b* and the downstream portion 20*c* exist in a downstream side of the supercharger 24, the downstream pressure P1 and the intermediate pressure P4 can become larger than the upstream pressure P2 at the supercharging time. In accordance with the present embodiment, an outlet of the second breather passage 42 is connected to the upstream portion 20*a*. Accordingly, it is possible to reduce the load of the pump 46, for example, in comparison with the case that the outlet of the second breather passage 42 is connected to the intermediate portion 20*b* or the downstream portion 20*c*.

In the case that some kind or another trouble is generated in the engine 10, and the leaking flow rate BL of the blow-by gas suddenly ascends, the blow-by gas in the engine 10 passes through the introduction passage 43 so as to flow into the intake passage 20. Accordingly, it is possible to prevent the pressure in the engine 10 from excessively ascending. Therefore, it is possible to inhibit the reliability of a seal member sealing between the interior of the engine 10 and the outer portion from being lowered. In other words, it is possible to maintain the prevention of the gas flow from the interior of the engine 10 to the outer portion, and the prevention of the gas intrusion from the outer portion of the engine 10 to the interior, at a high reliability. As a result, it is possible to inhibit the reliability of the engine 10 from being lowered.

In the case that the flow direction of the blow-by gas and the intake air in the engine 10 is different between the supercharging time and the non-supercharging time, the blow-by gas flow and the intake air flow in the engine 10 become disturbed each time there is a switch between the operating state and the non-operating state of the supercharger 24, and can stagnate temporarily. In the case that the flow direction of the blow-by gas in the passage connecting the interior of the engine 10 with the intake passage 20, and the flow direction of the intake air are counterchanged at the non-supercharging time and the supercharging time, the blow-by gas discharged from the interior of the engine can be again returned to the interior of the engine 10. In the case mentioned above, it is impossible to efficiently ventilate the interior of the engine 10. In other words, it is impossible to efficiently replace the blow-by gas in the engine 10 into the intake air.

However, in the present embodiment, the flow directions of the blow-by gas in the first breather passage 41 and the second breather passage 42 are always constant in both of the supercharging time and the non-supercharging time. Further, the flow direction of the intake air in the introduction passage 43 is always constant in both of the supercharging time and the non-supercharging time. Accordingly, even if the supercharging time and the non-supercharging time are switched, a back flow of the blow-by gas in the first breather passage 41 and the second breather passage 42 is not generated. In the same manner, a back flow of the intake air in the introduction passage 43 is not generated.

The inlet of the first breather passage 41 and the inlet of the second breather passage 42 are connected to the first oil separator 45 corresponding to a common portion (the same portion) in the engine 10. In other words, the blow-by gas in the engine 10 is always discharged to the outer portion from the first oil separator 45 with or without the operation of the supercharger 24. In other words, the blow-by gas in the engine 10 is discharged from the connecting portion of the first oil separator 45 in the crankcase 14. Further, the outlet of the introduction passage 43 is connected to the second oil separator 47. In other words, the intake air is always introduced to the interior of the engine 10 from the second oil separator 47 with or without the operation of the supercharger 24. In other words, the intake air is introduced to the interior of the engine 10 from the connecting portion of the second oil separator 47 in the head cover 13. Accordingly, it is possible to respectively fix the flow direction of the blow-by gas in the engine 10, and the flow direction of the intake air in the engine 10 with or without the operation of the supercharger 24. Accordingly, even if the supercharging time and the non-supercharging time are switched, the blow-by gas flow and the intake air flow in the engine 10 are not largely disturbed. Accordingly, it is possible to efficiently ventilate the interior of the engine 10.

The first embodiment has the following advantages.

(1) The blow-by gas processing apparatus is provided with the first breather passage 41, the second breather passage 42, and the introduction passage 43. The pump 46 is arranged in the second breather passage 42.

Since the intake negative pressure is generated in the downstream portion 20*c* at the non-supercharging time, the downstream pressure P1 is lower than the upstream pressure P2 and the intermediate pressure P4. Accordingly, the intake air in the upstream portion 20*a* passes through the introduction passage 43 so as to be introduced to the interior of the engine 10 on the basis of the pressure difference between the downstream pressure P1 and the upstream pressure P2. The blow-by gas in the engine 10 passes through the first breather passage 41 so as to be recirculated to the intake passage 20.

At the supercharging time, the electronic control unit 50 drives the pump 46, whereby the blow-by gas in the engine 10 passes through the second breather passage 42 so as to be recirculated to the intake passage 20. As a result, since the blow-by gas in the engine 10 is reduced, the intake air in the intake passage 20 passes through the introduction passage 43 so as to be introduced to the interior of the engine 10.

In other words, the blow-by gas processing apparatus ventilates the interior of the engine 10 by utilizing the intake negative pressure at the non-supercharging time, and ventilates the interior of the engine 10 by driving the pump 46 at the supercharging time. Accordingly, it is possible to always efficiently ventilate the blow-by gas in the engine 10.

(2) The electronic control unit 50 changes the gas pressure feeding amount of the pump 46 on the basis of the downstream pressure P1. Accordingly, it is possible to regulate the gas pressure feeding amount of the pump 46 in correspondence to the leaking flow rate BL of the blow-by gas changing in accordance with the downstream pressure P1. As a result, it is possible to compensate the lack of the gas discharging capacity in the case that the intake negative pressure comes to zero.

(3) The electronic control unit 50 stops the pump 46 in the case that the downstream pressure P1 is lower than the drive starting pressure $\alpha$. Accordingly, the interior of the engine 10 is ventilated on the basis of the blow-by gas discharge by the first breather passage 41, and the intake air introduction by the introduction passage 43, at the non-supercharging time. Further, in the case that the downstream pressure P1 is higher than the drive starting pressure $\alpha$, the electronic control unit 50 drives the pump 46. Accordingly, the interior of the engine 10 is ventilated on the basis of the blow-by gas discharge by the second breather passage 42, and the intake air introduction by the introduction passage 43, at the supercharging time. In other words, in the case that the intake negative pressure can sufficiently ventilate the interior of the engine 10, the electronic control unit 50 stops the pump 46. As mentioned above, the electronic control unit 50 does not always drive the pump 46. Therefore, it is possible to efficiently drive the pump 46.

(4) The inlet of the introduction passage 43 is connected to the upstream portion 20*a* corresponding to the upstream of the supercharger 24. Accordingly, it is possible to prevent the pressure in the engine 10 from becoming excessively high at the supercharging time.

(5) The outlet of the second breather passage 42 is connected to the upstream portion 20*a* corresponding to the upstream of the supercharger 24. Accordingly, it is possible to reduce the load of the pump 46, for example, in comparison with the case that the pump 46 pressure feeds the gas to the intermediate portion 20*b* or the downstream portion 20*c*.

(6) The inlet of the first breather passage 41 and the inlet of the second breather passage 42 communicate with the first oil separator 45 corresponding to the same portion in the engine 10. Accordingly, even if the supercharging time and the non-supercharging time are switched, the blow-by gas flow in the engine 10 and the great disturbance of the intake air flow are hardly generated. Therefore, it is possible to efficiently ventilate the interior of the engine 10.

(7) The outlet of the introduction passage 43 is connected to the head cover 13. Generally, if the blow-by gas deteriorates the oil, oil sludge is generated. The oil sludge can be generated in the crank chamber 14*a* and/or the interior of the head cover 13, and the oil sludge can be more easily generated in the interior of the head cover 13. Since the introduction passage 43 in accordance with the present embodiment can directly feed the intake air to the interior of the head cover 13, the introduction passage 43 suppresses the generation of the oil sludge more efficiently.

(8) The inlet of the first breather passage 41, and the inlet of the second breather passage 42 are connected to the crank chamber 14*a*. The outlet of the introduction passage 43 is connected to the head cover 13. Accordingly, the intake air introduced to the interior of the head cover 13 from the introduction passage 43 efficiently pushes out the blow-by gas in the order of the interior of the head cover 13, the crank chamber 14*a* and the intake passage 20. In other words, a whole of the interior of the engine 10 is efficiently ventilated.

A description will be given below of a second embodiment according to the present invention. The description will be mainly given of a different point between the second embodiment and the first embodiment.

The electronic control unit 50 in accordance with the first embodiment uses only the downstream pressure P1 as a setting parameter for setting the gas pressure feeding amount of the pump 46. However, an electronic control unit 50 in accordance with the second embodiment employs both of the downstream pressure P1 and the coolant temperature THW, as setting parameters.

If the temperature (the coolant temperature THW) of the engine 10 is lowered, the electronic control unit 50 increases an increasing degree of the fuel injection amount in accordance with the amount increasing process. In other words, if the temperature of the engine 10 is lowered, a contaminated material such as an unburned fuel or the like contained in the leaked blow-by gas from the combustion chamber 18 to the crank chamber 14*a* is increased. If the temperature of the engine 10 is lowered, the gas temperature and the oil temperature in the engine 10 are lowered. Therefore, the contaminated material in the blow-by gas tends to be mixed more into the oil.

Accordingly, if the temperature of the engine 10 is lowered, the electronic control unit 50 in accordance with the second embodiment increases the gas pressure feeding amount of the pump 46. In other words, if the coolant temperature THW is lowered, the electronic control unit 50 increases the gas discharge amount from the interior of the engine 10, and increases the intake air introduction amount to the interior of the engine 10. As a result, it is possible to improve the ventilating performance of the interior of the engine 10. In other words, it is possible to suppress the deterioration of the oil by the blow-by gas.

Figure 5:
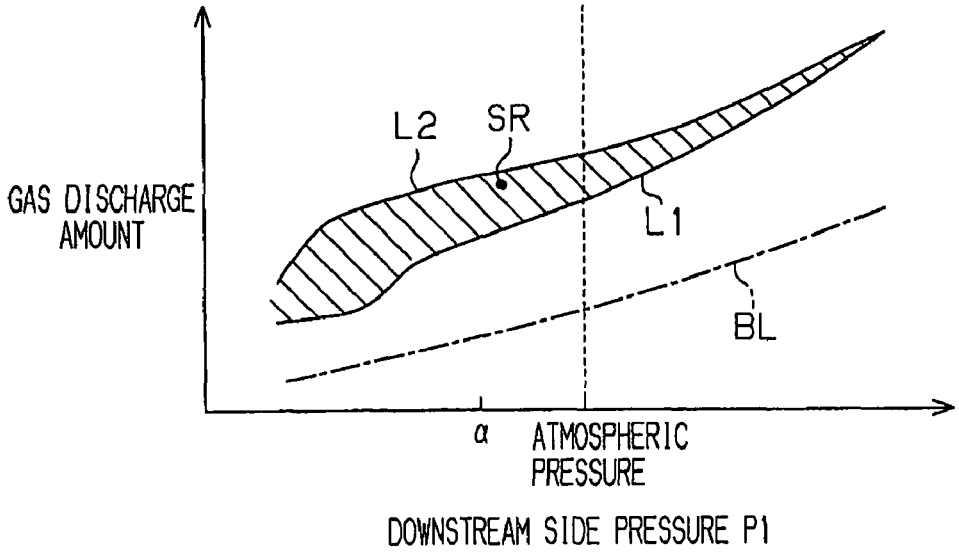
FIG. 5 shows a second embodiment according to the present invention, and shows a relationship between a gas discharge amount from the interior of an engine, and a pressure in a downstream side of a throttle valve, in the case that a coolant temperature is a predetermined value.

FIG. 5 shows a relationship between a gas discharge amount from the interior of the engine 10, and the downstream pressure P1, in the case that the coolant temperature THW is a predetermined value. In other words, FIG. 5 shows a first total breather line L1 and a second total breather line L2. The first total breather line L1 is the same as the total breather line L1 in FIG. 4 in the first embodiment.

In the case that the temperature of the engine 10 is high such as a warm-up finishing time of the engine 10, for example, in the case that the coolant temperature THW $\geqq 80°$ C., the electronic control unit 50 drives the pump 46 in such a manner as to achieve the gas discharge amount shown in the first total breather line L1. In other words, the electronic control unit 50 sets the gas pressure feeding amount on the basis of only the downstream pressure P1. In this case, the control of the pump 46 is the same as the first embodiment.

On the other hand, in the case that the coolant temperature THW is low, for example, in the case of the coolant temperature THW $<80°$ C., the electronic control unit 50 drives the pump 46 in such a manner as to come to the gas pressure feeding amount indicating the second total breather line L2. The second total breather line L2 is always positioned above the first breather line BR1 in both of the case that the downstream pressure P1 is less than the atmospheric pressure, and the case that it is equal to or more than the atmospheric pressure. In other words, the electronic control unit 50 drives the pump 46 even in the case that the downstream pressure P1 is equal to or less than the drive starting pressure $\alpha$. A hatched region SR shown in FIG. 5 indicates the difference between the second total breather line L2 and the first breather line BR. In other words, the hatched region SR indicates the increased amount of the gas pressure feeding amount of the pump 46. If the downstream pressure P1 is lowered, the hatched region SR is increased. It is set such that if the coolant temperature THW is lowered, the hatched region SR is increased. In other words, the second total breather line L2 indicates a gas discharge amount obtained by increasing the first total breather line L1 corresponding to the gas discharge amount corresponding only to the downstream pressure P1 so as to also correspond to the coolant temperature THW.

As mentioned above, the electronic control unit 50 in accordance with the second embodiment increases the gas pressure feeding amount of the pump 46 in correspondence to the temperature of the engine 10, in the case that the temperature of the engine 10 is low so as to tend to cause the oil deterioration by the blow-by gas. Accordingly, it is possible to improve the ventilating performance of the interior of the engine 10. As a result, it is possible to inhibit the contaminated material from being mixed into the oil. In other words, it is possible to preferably suppress the oil deterioration by the blow-by gas.

The second embodiment has the advantages (1) to (6) and further has the following advantage (7).

(7) If the coolant temperature THW is lowered, the electronic control unit 50 increases the drive current of the pump 46. Accordingly, it is possible to preferably suppress the oil deterioration by the blow-by gas.

Each of the embodiments may be modified as follows.

In the first embodiment, the pump 46 may be driven in the case that the downstream pressure P1 is lower than the drive starting pressure $\alpha$. In this case, it is possible to rapidly discharge the blow-by gas in the case of $P1<\alpha$.

In the second embodiment, the pump 46 may be controlled in such a manner as to increase the gas pressure feeding amount of the pump 46 by a previously set amount in the case that the coolant temperature THW is lower than a predetermined temperature, and equalize the gas pressure feeding amount of the pump 46 with the first total breather line L1 in the case that the coolant temperature THW is equal to or more than the predetermined temperature.

In the second embodiment, an index value of the temperature of the engine 10 is not limited to the coolant temperature THW, but may be constituted, for example, by a detected value of an oil temperature. Further, the temperature of the engine 10 may be directly detected.

The drive system of the pump 46 is not limited to the electric drive system, but may employ an engine drive system utilizing a rotation of the engine output shaft, or an oil drive system utilizing the oil pressure.

Figure 6:
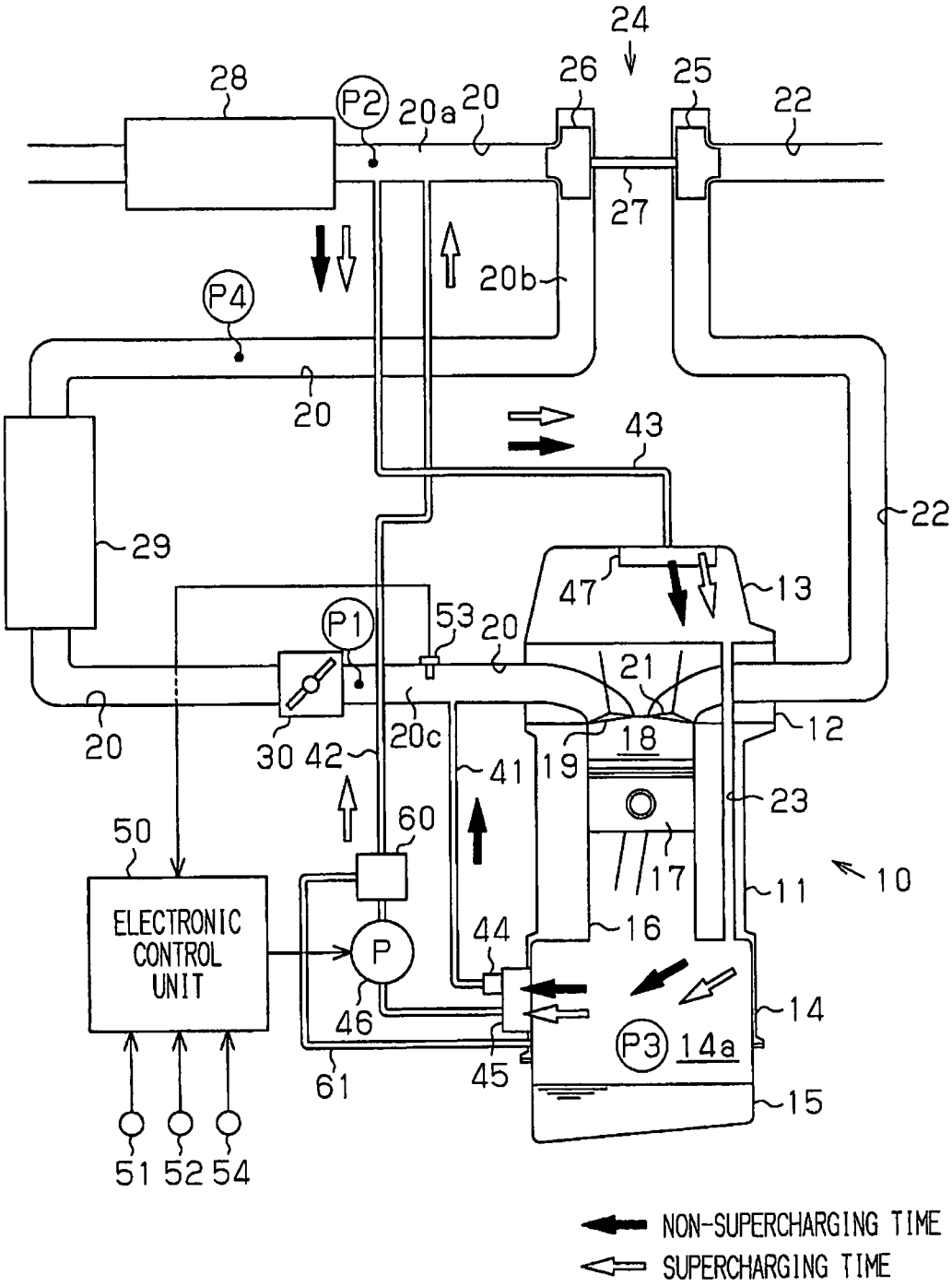
FIG. 6 is a schematic view of a blow-by gas processing apparatus in accordance with a modified embodiment of the present invention.

As shown in FIG. 6, a third oil separator 60 and a return passage 61 may be provided. The third oil separator 60 is arranged in a portion of the second breather passage 42 between the pump 46 and the intake passage 20. The return passage 61 connects the third oil separator 60 with the crank chamber 14*a*.

An oil separating capacity of the third oil separator 60 can be set in such a manner as to match to the gas flow rate of the second breather passage 42. Accordingly, the third oil separator 60 can reliably separate the oil from the gas flowing through the second breather passage 42. The return passage 61 returns the oil in the third oil separator 60 to the crank chamber 14*a*.

At a time of driving the pump 46, the pressure in the portion of the second breather passage 42 between the pump 46 and the engine 10 becomes lower than the pressure in the portion of the second breather passage 42 between the pump 46 and the intake passage 20. In other words, the intake pressure of the pump 46 becomes lower than the discharge pressure of the pump 46. Since the third oil separator 60 is arranged between the pump 46 and the intake passage 20, the engine internal pressure P3 becomes lower than an internal pressure of the third oil separator 60. Accordingly, it is possible to efficiently return the oil in the third oil separator 60 to the interior of the engine 10.

The third oil separator 60 in FIG. 6 is not limited to be arranged between the pump 46 and the intake passage 20, but may be arranged between the pump 46 and the engine 10.

The blow-by gas processing apparatus may also be applied to the engine 10 which does not execute the amount increasing process of the target fuel injection amount Qm.

The outlet of the second breather passage 42 may be connected to the intermediate portion 20*b* or the downstream portion 20*c*.

The inlet of the introduction passage 43 may be connected to the intermediate portion 20*b* as long as it is possible to prevent the pressure in the engine 10 from becoming excessively high at the supercharging time.

Figure 7:
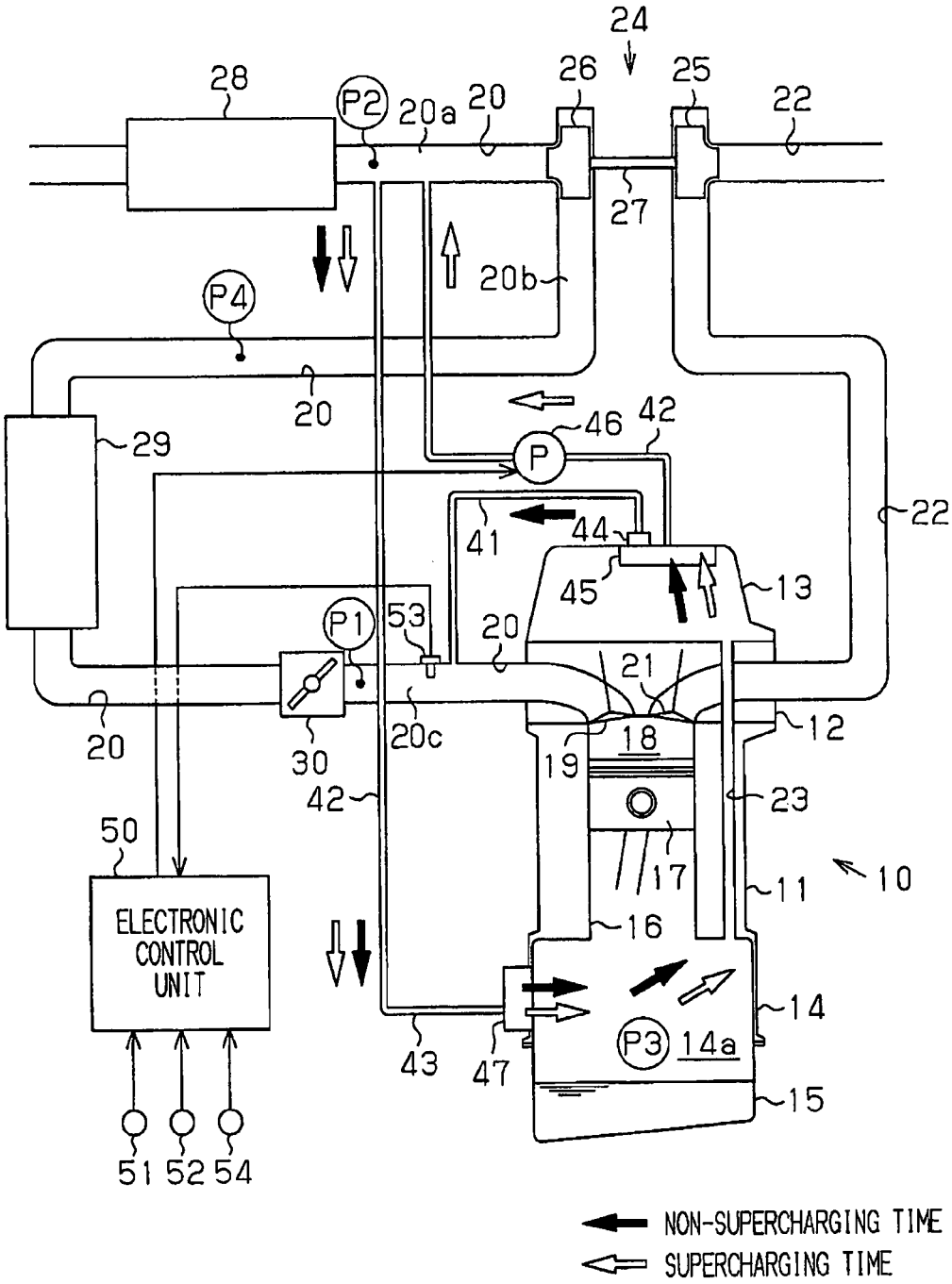
FIG. 7 is a schematic view of a blow-by gas processing apparatus in accordance with another modified embodiment.

As shown in FIG. 7, the first oil separator 45 may be arranged in the head cover 13, and the second oil separator 47 may be arranged in the crankcase 14. In other words, the inlet of the first breather passage 41, and the inlet of the second breather passage 42 are connected to the head cover 13. The outlet of the introduction passage 43 is connected to the crank chamber 14*a*.

Figure 8:
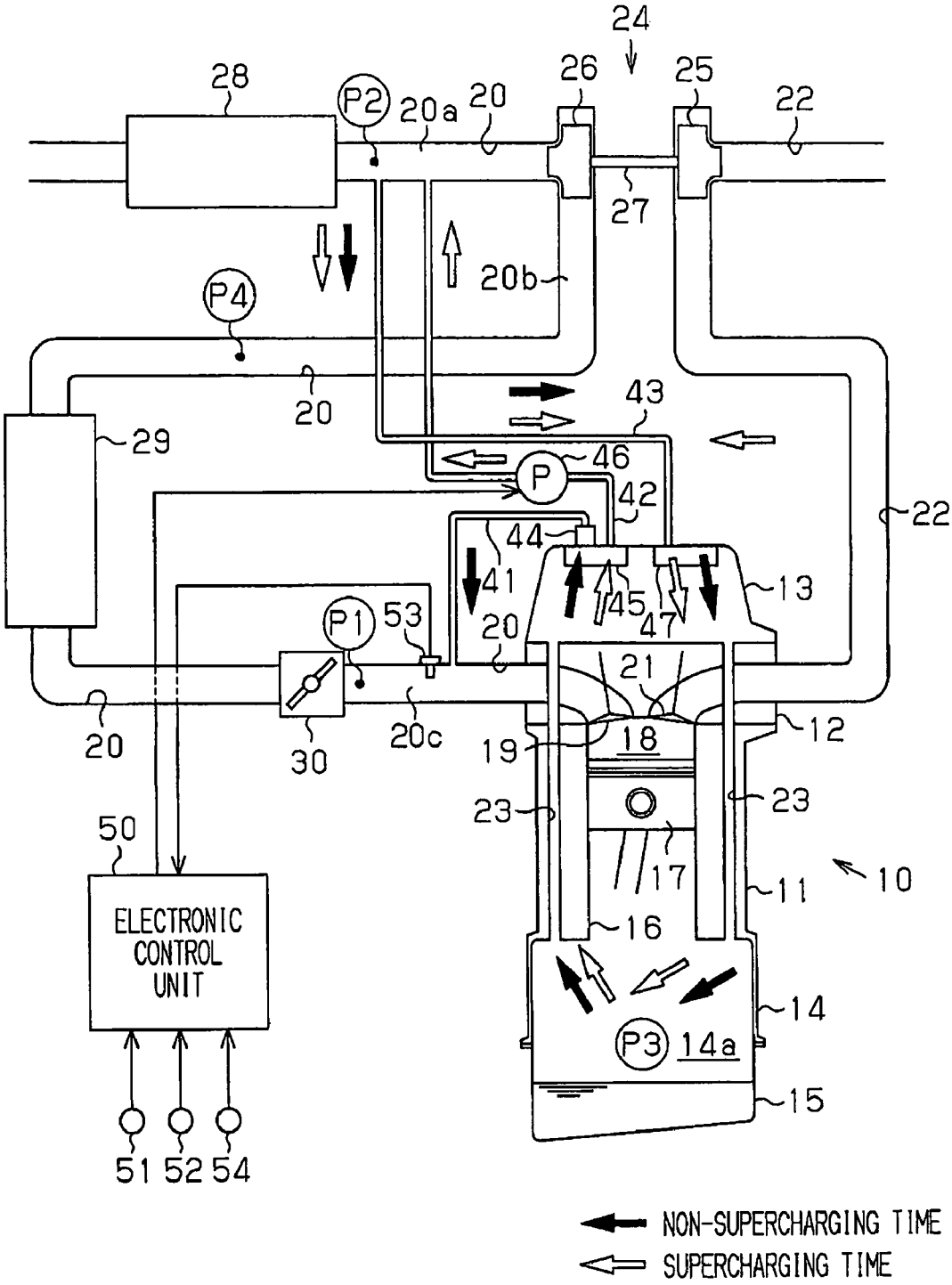
FIG. 8 is a schematic view of a blow-by gas processing apparatus in accordance with another modified embodiment.

As shown in FIG. 8, both of the first oil separator 45 and the second oil separator 47 may be arranged in the head cover 13. In other words, all of the inlet of the first oil separator 45, the inlet of the second oil separator 47, and the outlet of the introduction passage 43 are connected to the head cover 13. In this case, it is desirable to devise the shape of the communicating passage 23 in such a manner that the intake air is smoothly introduced from the interior of the head cover 13 to the crank chamber 14*a*, and that the blow-by gas is conducted out from the crank chamber 14*a* to the interior of the head cover 13. For example, two communicating passages 23 are arranged on a diagonal line of the cylinder block 11.

Figure 9:
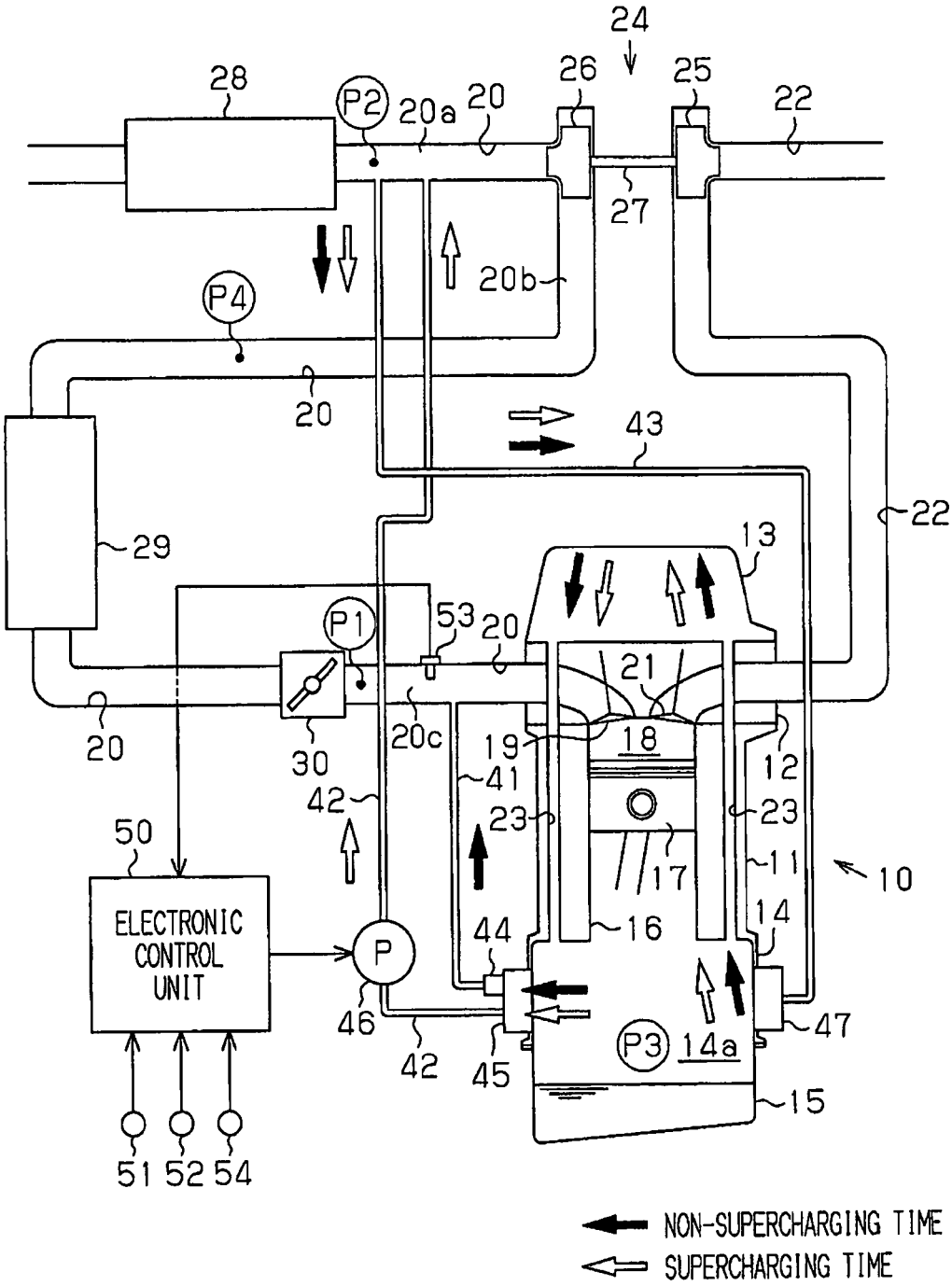
FIG. 9 is a schematic view of a blow-by gas processing apparatus in accordance with another modified embodiment.

As shown in FIG. 9, both of the first oil separator 45 and the second oil separator 47 may be arranged in the crankcase 14. In other words, all of the inlet of the first breather passage 41, the inlet of the second breather passage 42, and the outlet of the introduction passage 43 are connected to the crank chamber 14*a*.

In the case that it is possible to avoid the oil intrusion from the interior of the engine 10 to the first breather passage 41 and the second breather passage 42, the first oil separator 45 may be omitted. Further, in the case that the oil intrusion from the interior of the engine 10 to the introduction passage 43, the second oil separator 47 may be omitted.

Figure 10:
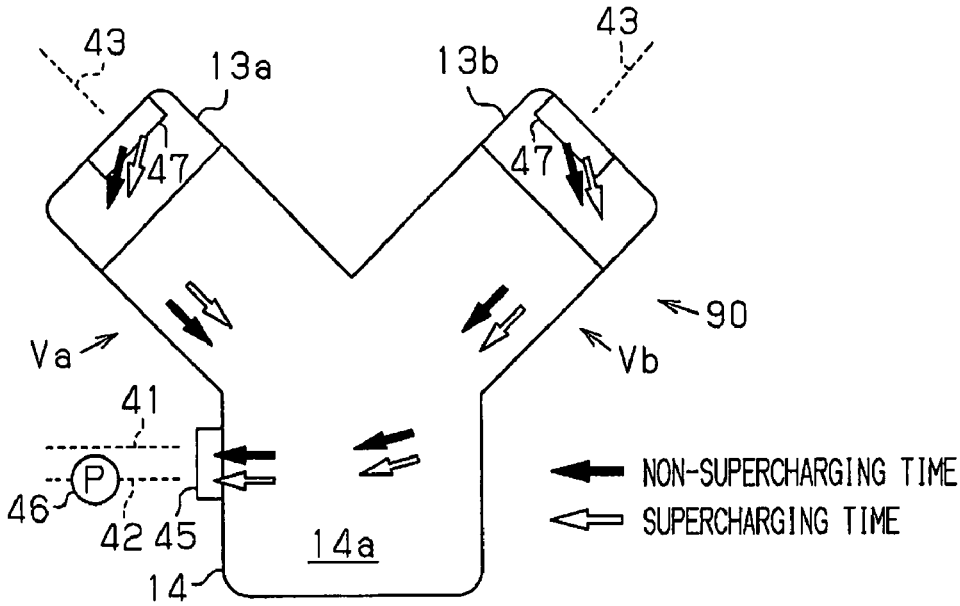
FIG. 10 is a schematic view of a blow-by gas processing apparatus in accordance with another modified embodiment.

As shown in FIG. 10, the blow-by gas processing apparatus may be applied to a V-engine 90 having cylinders arranged to form the letter V. The outlet of the introduction passage 43 is connected to each of a left head cover 13*a* provided in a left bank Va and a right head cover 13*b* provided in a right bank Vb. The inlet of the first breather passage 41, and the inlet of the second breather passage 42 are connected to the common crankcase 14.

Figure 11:
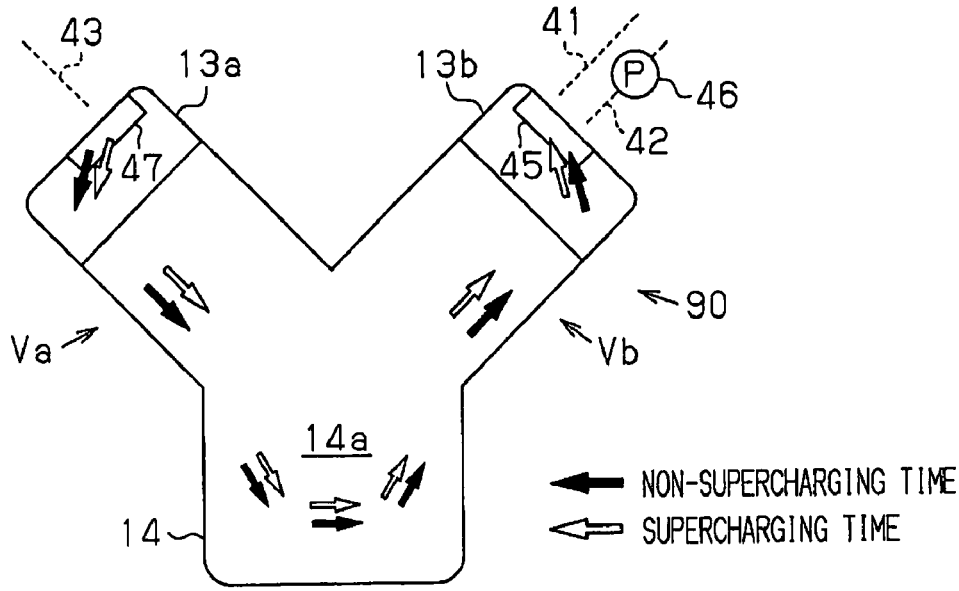
FIG. 11 is a schematic view of a blow-by gas processing apparatus in accordance with another modified embodiment.

As shown in FIG. 11, the inlet of the first breather passage 41, and the inlet of the second breather passage 42 may be connected to the right head cover 13*b*. The outlet of the introduction passage 43 is connected only to the left head cover 13*a*.

Figure 12:
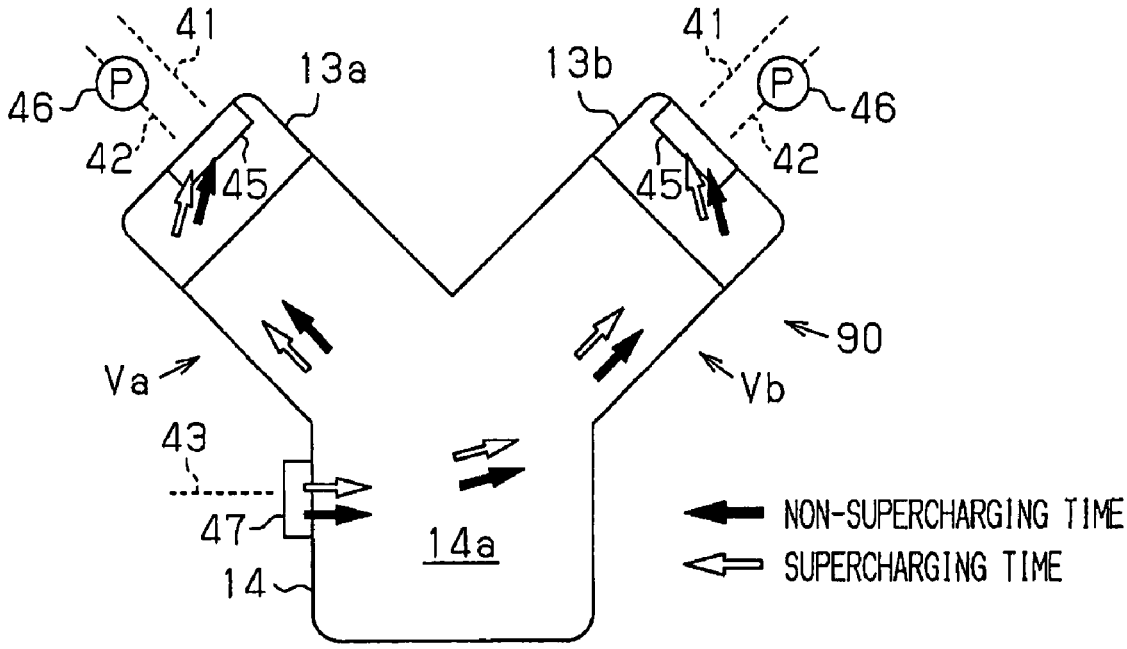
FIG. 12 is a schematic view of a blow-by gas processing apparatus in accordance with another modified embodiment.

As shown in FIG. 12, the inlet of the first breather passage 41 and the inlet of the second breather passage 42 may be connected to the left head cover 13*a*, and the outlet of the introduction passage 43 may be connected to the crankcase 14. The inlet of the first breather passage 41 and the inlet of the second breather passage 42 are also connected to the right head cover 13*b*.

The inlet of the first breather passage 41 and the inlet of the second breather passage 42 may be respectively connected to different portions in the engine 10.

The supercharger 24 provided in the engine 10 is not limited to the exhaust gas drive system, but may be constituted by an engine drive system. Further, the intake passage 20 to the intercooler 29 may be omitted. The blow-by gas processing apparatus in accordance with the present invention may be applied to the engine 10 in these cases.

The invention claimed is:

1. A blow-by gas processing apparatus applicable to an internal combustion engine, wherein an intake passage extends from the engine, intake air flows through the intake passage from an upstream side to a downstream side, whereby the intake air flows toward the engine, a supercharger and a throttle valve are arranged in the intake passage, the throttle valve is positioned downstream of the supercharger, the supercharger pressure feeds the intake air flowing through the intake passage toward the engine, thereby supercharging the intake air to the engine, the throttle valve variably sets a passage cross-sectional area of the intake passage, and the intake passage gas an upstream portion positioned upstream of the supercharger, an intermediate portion positioned between the supercharger and the throttle vale, and a downstream portion positioned downstream of the throttle valve, the processing apparatus comprising:

a first breather passage connecting an interior of the engine with the downstream portion, the first breather passage having a one-way valve allowing only a gas discharge from the interior of the engine to the intake passage;

a second breather passage connecting the interior of the engine with the upstream portion of intake passage, the second breather passage having a pump pressure feeding gas from the interior of the engine to the intake passage; and an introduction passage connecting at least one of the upstream portion and the intermediate portion with an interior of the engine, an electronic control unit that controls the gas pressure fed by the pump, wherein the amount of the gas pressure fed by the pump is changed on the basis of a pressure of the downstream portion.

2. The processing apparatus according to claim 1, wherein in the case that a pressure of the downstream portion is lower than a predetermined value, the pump is stopped.

3. The processing apparatus according to claim 1, wherein if a temperature of the engine is lowered, the amount of the gas pressure fed by the pump is increased.

4. The processing apparatus according to claim 1, further comprising: an oil separator provided in the second breather passage; and a return passage connecting an interior of the oil separator with the interior of the engine.

5. The processing apparatus according to claim 4, wherein the oil separator is arranged between the pump and the intake passage.

6. The processing apparatus according to claim 1, wherein the introduction passage is connected to the upstream portion.

7. The processing apparatus according to claim 1, wherein the first breather passage and the second breather passage are connected to a common portion in the interior of the engine.

8. The processing apparatus according to claim 1, further comprising a control portion controlling an opening degree of the pump.

9. The processing apparatus according to claim 1, wherein the electronic control unit controls the gas pressure fed by the pump as the gas pressure continuously varies.

* * * * *